US005922980A

United States Patent [19]

Arteaga

[11] Patent Number: 5,922,980

[45] Date of Patent: Jul. 13, 1999

[54] SOUND MUFFLING DEVICE FOR CYMBAL PRACTICE

[76] Inventor: Alfonso S. Arteaga, 3129 Ashbrook Dr., Chino Hills, Calif. 91709

[21] Appl. No.: 08/857,098

[22] Filed: May 15, 1997

[51] Int. Cl.[6] ..... G10D 13/02

[52] U.S. Cl. ..... 84/411 M; 84/422.3

[58] Field of Search ..... 84/411 M, 422.3; 156/308.4

[56] References Cited

U.S. PATENT DOCUMENTS 2,893,283 7/1959 Ippolito ..... 84/411 R 4,927,474 5/1990 Pawloski ..... 156/66

*Primary Examiner*—William M. Shoop, Jr.
*Assistant Examiner*—Shih-yung Hsieh
*Attorney, Agent, or Firm*—George J. Netter

[57] ABSTRACT

A cymbal (10) sound muffling device (18) for use during practice includes a flexible circular disc (20) of elastic sheet rubber or plastic with an edge margin (24) that extends back onto the disc lower surface (25). In assembly, the edge margin (24) is stretched over the cymbal edges such that disc covers the cymbal upper surface and the edge margin (24) contacts the cymbal lower surface. Practice striking of the so-enclosed cymbal with a drumstick (26) provides an authentic playing feel to the practicing musician.

12 Claims, 2 Drawing Sheets

SOUND MUFFLING DEVICE FOR CYMBAL PRACTICE

BACKGROUND

1. Background of the Invention

The present invention relates generally to a cymbal practice device, and, more particularly, to such a device reducing sound intensity produced while maintaining substantially authentic feel for the player.

2. Description of Related Art

Practice playing of a cymbal in the customary fashion is frequently objectionable to those within hearing range of the practicing musician. When the solo practice session takes place in an apartment, for example, a number of individuals may be subjected to the undesirable repetitive sound of the cymbal unrelieved by accompanying music. It is desirable, therefore, to provide means for use during practice cymbal playing which substantially reduces the sound produced.

One approach to solving this problem is disclosed in U.S. Pat. No. 4,037,509 in which a circular practice cover 26 made of felt which is received onto the upper striking surface of a cymbal 10 during practice and clamped thereto by a pair of straps 30 and 32. Reinforcing material 36, 38 is used to prevent deterioration of the felt.

Also, U.S. Pat. No. 4,102,235 depicts a circular oil-tanned leather pad 10 which is placed on the upper surface of a cymbal and secured in position by snaps 43.

Although there are known prior devices that achieve sound muffling of a cymbal during practice, none are completely satisfactory in that they are either lacking in authentic playing "feel", are relatively complex to assemble to and disassemble from a cymbal, or are prohibitively expensive to manufacture.

SUMMARY OF THE INVENTION

A musical cymbal with which the present invention is most advantageously employed generally includes a metal disc of, say, 8–24 inches in diameter which is typically struck on an upper major surface or edge, with a drumstick during playing. The device to be described can also be utilized with a so-called "high hat" arrangement of two cymbals on a common shaft which are selectively clapped together in use.

The device of the present invention consists of a generally circular sheet of rubber or plastic of similar flexibility and resiliency characteristics, and relatively thin. A centralized opening permits receipt over the central connection point of a cymbal supporting a shaft such that the muffling device may be placed over the upper end of such a supporting column and brought down into a snug intimate contact with the cymbal outer surface. The device diameter is substantially identical to that of the cymbal or slightly larger. Further outer edge portions of material unitary with the disc portion extend inwardly from the outer edge and back towards the device central axis a limited distance. To assemble the device to a cymbal, the device central opening is received onto the cymbal shaft upper end and the remainder extending onto the cymbal upper major surface with the outer edge portion being folded about the cymbal peripheral edge so as to be on the opposite or lower surface of the cymbal in gripping relation thereto. In practice use, drumsticks may strike the upper surface or edge of the protected cymbal without producing the typical penetrating sound associated with the cymbal.

When the described device is placed on the upper cymbal of a high-hat cymbal arrangement, not only is the upper cymbal prevented from making noise when struck with a drumstick, but also the device edge portion extending underneath the topmost cymbal insulates the two cymbals from metal-to-metal contact thereby preventing sound other than an extremely muffled one being produced during practice.

Not only is the production of objectionable sound not produced by use of the device in cymbal practice, but the relatively thin rubber or plastic disc causes a drumstick to rebound in a highly authentic manner.

BRIEF DESCRIPTION OF THE DRAWING

These and other objects and advantages of the invention will become more readily apparent upon reading the following detailed description and upon reference to the attached drawings in which.

DESCRIPTION OF A PREFERRED EMBODIMENT

It is customary for a musical drummer to practice with cymbals in order to work out some technical aspect of performance, or to work out a prescribed cymbal accompaniment for a new composition or orchestral arrangement. Such practicing is typically accomplished by the drummer in a solo manner without accompanying instruments or recorded music. The sound of solo cymbal work is not especially prized by neighbors or individuals who are within hearing distance since it is somewhat tedious when not accompanied by other musical instruments.

Figure 1:
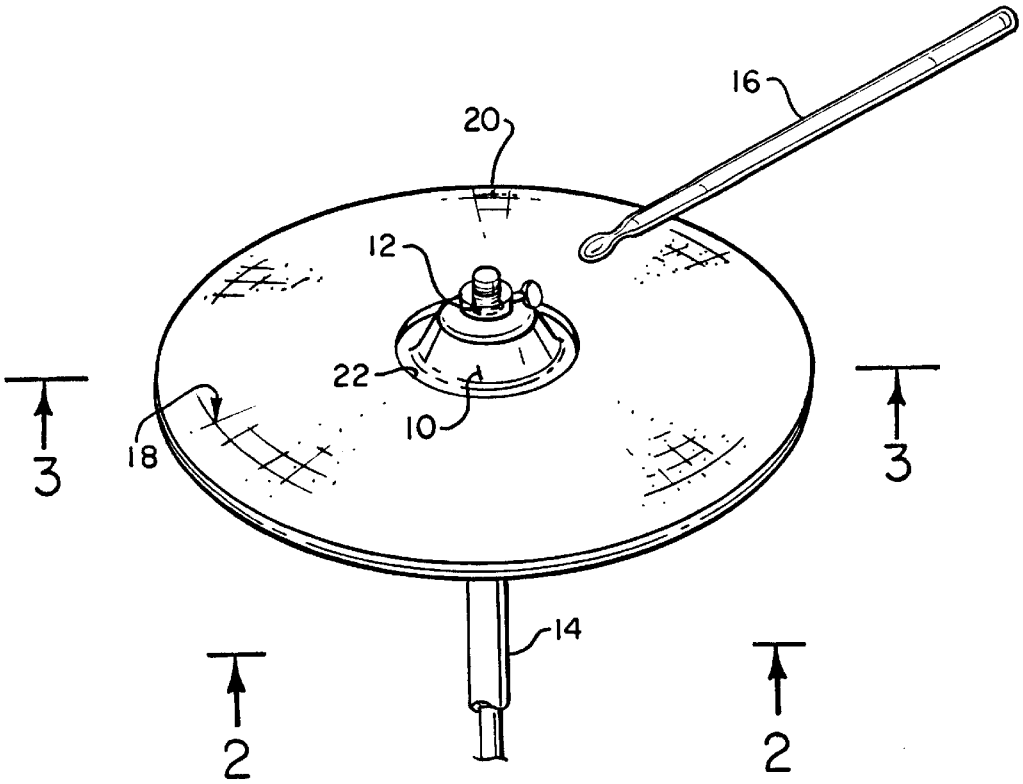
FIG. 1 is a perspective view of a cymbal with the device assembled thereon for use in practice.

A cymbal with which the present invention has its primary advantage is essentially a metal disc of a diameter which may be found in many commercial or popular style drum sets to range from 8–24 inches and enumerated in FIG. 1 as 10. The cymbal is provided with a central opening 12 at which it is typically pivotally mounted on the upper end portion of a vertical shaft or column 14. The drummer plays the cymbal 10 by striking it with a drumstick 16, for example, or so-called brushes (not shown). As will be more particularly described, the device of the present invention enumerated as 18 can be readily mounted to a cymbal 10 for use during a solo practice session to substantially reduce the sound that the cymbal normally makes. Also, when practice session is through, the device 18 may be quickly and easily removed from the cymbal so that the cymbal may be used for normal music production purposes.

Still referring to FIG. 1, the device of the present invention 18 is seen to include a generally circular disc 20 constructed of flexible, relatively thin sheet rubber or plastic material with a centrally located opening 22 formed therein. The diameter D of the circular disc 20 is substantially identical to or slightly larger than that of the cymbal 10.

Figure 2:
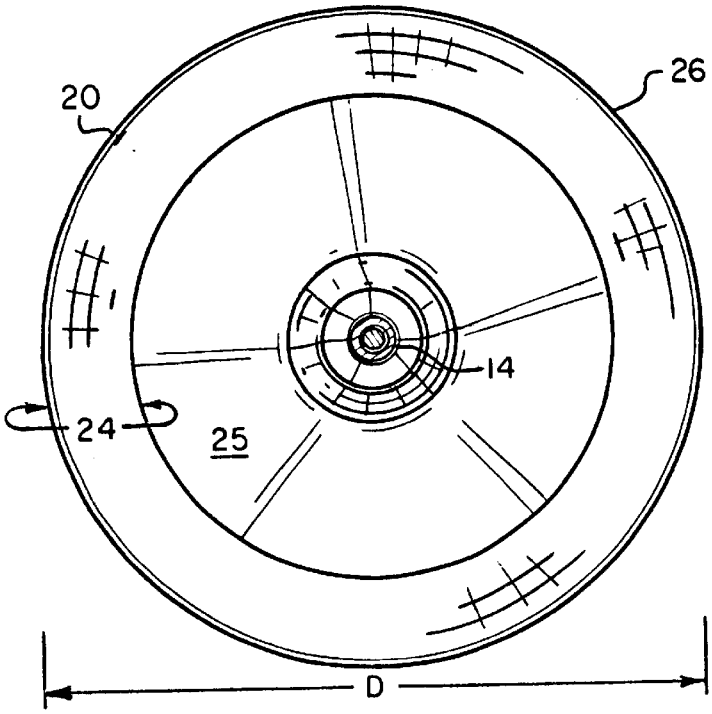
FIG. 2 is a bottom plan view of the invention taken along the line 2—2 of FIG. 1.
Figure 3:
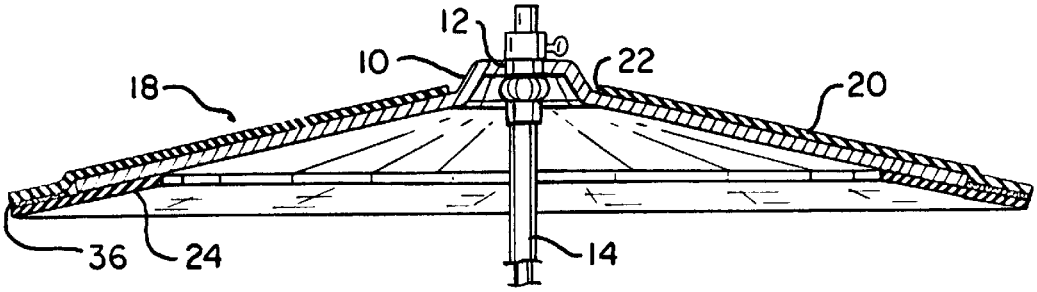
FIG. 3 is a side elevational, sectional, partially fragmentary view of the invention taken along the line 3—3 of FIG. 1.

Turning now to both FIGS. 2 and 3, an edge margin 24 is seen to extend back onto the lower surface 25 of the disc 20. The geometry and dimensions of disc 20, as compared to those of the cymbal, are such that on assembly the disc major surface is received in close intimate contact with the cymbal upper surface and the edge margins 24 frictionally grip the disc lower surface 25. In this manner, the device is secured to the cymbal and will not move around relative to the cymbal during a practice session.

For subdued sound level practice, when the cymbal with the device 18 in covering relation thereto is struck with a drumstick 16, instead of the drumstick being brought to bear on the metal of the cymbal itself, it strikes the material of the disc 20 on its outermost surface or at the edge 26 in the event the drumstick action is directed there. The disc sheet material serves to muffle or deaden the normally penetrating sound of the cymbal. Also, as already noted the gripping action of the margin 24 serves to maintain substantially the entire upper surface of the cymbal and its edges covered with the disc material despite even rather rapid and hard striking with drumsticks for an extended practice session. Still further, the material composing the sheet 20 is sufficiently thin and hard to provide a "feel" to the drummer that is lifelike and authentic to normal cymbal playing, thereby making the practice session a more genuine one and not requiring mental or physical action modifications when a true performance is being provided later. This matter of feel is important and a fundamental requirement of any practice session and is not completely satisfactory in any known prior art device or apparatus.

The edge margin 24 of the described device provides an additional advantage in that a device 18 designed to accommodate, say, a 15-inch cymbal can also accommodate a 14-inch cymbal due to the gripping action of the edge margin. The prior art devices typically can only be satisfactorily used with a specific size cymbal.

Figure 4:
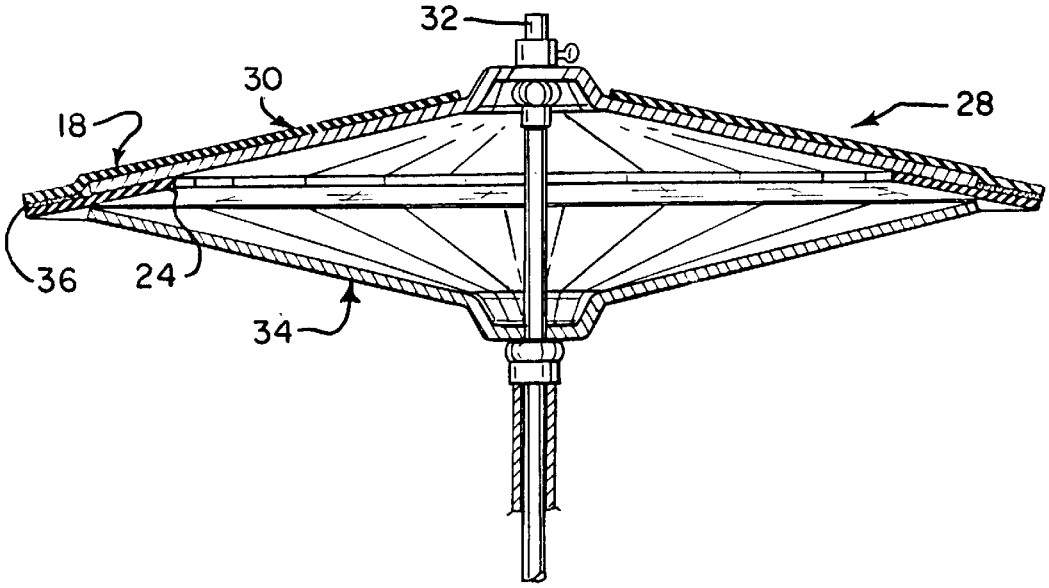
FIG. 4 is a side elevational view showing application of the device of this invention used for a high-hat cymbal arrangement.

FIG. 4 depicts a high-hat cymbal arrangement 28 in which a first upper cymbal 30 is arranged on a common column or shaft 32 with a second cymbal 34 spaced downwardly therefrom on the same column. In normal use, the drummer by a foot operated linkage moves the two cymbals apart and allows them to fall together striking their edge portions against one another to achieve a unique cymbal sound. To utilize the present invention on a high-hat arrangement, the device 18 is assembled onto just the upper cymbal 30. On moving the cymbals together for striking, the edge margin 24 intervenes between the edge portions of the two cymbals muffling the normal cymbal sound from being created.

Although other materials may be found advantageous in constructing the described cymbal muffling device, excellent results were obtained in a practical construction of the device 18 from a material sold under the trade designation silicone rubber or neoprene rubber by Rubberite Corp., Buena Park, Calif. with the material thickness being approximately 1/32–1/16 inches throughout except for the peripheral edge portion which was slightly more.

For the ensuing description of the preferred manner of constructing the device 18, reference is made particularly to FIG. 3. Initially, a disc 20 of appropriately thick rubber or plastic having a diameter D is provided with the central opening 22 in conventional manner (e.g., cutting). Next, an annular edge margin 24 formed of the same material as the disc 20 is laid onto the disc 20 with the peripheral edges coincident with one another. Then the outer edge 26 is then fused into a unitary edge by the application of heat and pressure or through application of ultrasonic techniques. Optionally, the annular edge margin 24 can be affixed to the disc 20 by a securing means 36 such as a quantity of adhesive (FIG. 3).

Although the present invention has been described in connection with a preferred embodiment, it is to be understood that those skilled in the appertaining arts may contemplate modifications within the spirit of the invention as described and within the ambit of the appended claims.

What is claimed is:

1. An enclosure for a cymbal constructed of a generally circular metal disc, comprising:

a circular disc of a flexible sound-damping material having a predetermined diameter and thickness, said disc including a central opening;

an annular sheet of flexible sound-damping material of the same predetermined diameter disposed onto said disc with sheet and disc edges being coincident with each other; and means securing peripheral circular edge portions of said disc and sheet to one another leaving a separable space inwardly of said means.

2. An enclosure as in claim 1, in which the securing means includes a quantity of adhesive located between facing edge portion surface of the disc and annular sheet.

3. An enclosure as in claim 1, in which the securing means includes a seal formed by the facing contacting edge portion surfaces of the disc and annular sheet.

4. An enclosure as in claim 3, in which the seal is a heat and pressure seal composed of the material forming said disc and annular sheet.

5. An enclosure as in claim 1, in which the disc and annular sheet are made from a material selected from the group of rubber and plastic.

6. An enclosure as in claim 1, in which the disc and annular sheet are made from a material selected from the group of silicone rubber, neoprene rubber.

7. An enclosure as in claim 6, in which the disc has a thickness in the range of 1/32–1/16 of an inch.

8. A practice cymbal assembly providing a reduced amount of sound while maintaining authentic playing feel, comprising:

a metal cymbal having a peripheral circular edge of predetermined diameter with first and second opposite major surfaces and centrally located mounting means; and an enclosure for said cymbal including, a flexible disc having for receipt onto the cymbal in covering relation to the first major surface, said disc having a central opening which aligns with the cymbal mounting means, an annular sheet having its peripheral edge portions sealed to facing edge portions of the disc, said sheet extending over and in contact with the disc second major surface;

said disc and annular sheet being so dimensioned and constructed of a material having such elasticity that the enclosure may be releasably stretched to fit on the cymbal with the disc lying against the cymbal first major surface and the annular sheet against the second major surface.

9. A practice cymbal assembly as in claim 8, in which the disc and annular sheet are constructed of silicone rubber.

10. A practice cymbal assembly as in claim 9, in which the disc has a thickness in the range of 1/32–1/16 of an inch.

11. A practice cymbal assembly as in claim 8, in the disc and annular sheet are constructed of neoprene.

12. A practice cymbal assembly as in claim 11, in which the disc has a thickness within about the range of 1/32–1/16 of an inch.

* * * * *